US005141406A

United States Patent [19]

Ream

[11] Patent Number: 5,141,406

[45] Date of Patent: Aug. 25, 1992

[54] HIGH-LIFT TUBULAR PUMP

[75] Inventor: William C. Ream, Manheim, Pa.

[73] Assignee: GPU Nuclear Corporation, Parsippany, N.J.

[21] Appl. No.: 717,868

[22] Filed: Jun. 19, 1991

Related U.S. Application Data

[63] Continuation of Ser. No. 488,888, Mar. 6, 1990, abandoned.

[51] Int. Cl.[5] ..... F04F 1/02

[52] U.S. Cl. ..... 417/145; 417/149

[58] Field of Search ..... 417/144, 145, 149

[56] References Cited

U.S. PATENT DOCUMENTS

| | | | |
|---|---|---|---|
| 5,179 | 6/1847 | Winder . | |
| 47,034 | 3/1865 | Pease . | |
| 494,927 | 4/1893 | Lorey et al. | 417/149 |
| 557,812 | 4/1896 | Hanna et al. | 417/149 |
| 1,060,826 | 5/1913 | DeHymel . | |
| 1,201,073 | 10/1916 | Morrow | 417/144 |
| 1,778,723 | 10/1930 | Oeder . | |
| 2,777,399 | 1/1957 | Clark . | |
| 2,976,814 | 3/1961 | Ver Planck et al. . | |
| 3,310,002 | 3/1967 | Wilburn . | |
| 3,315,693 | 4/1967 | Braun | 251/368 X |
| 3,797,968 | 3/1974 | Elfarr | 417/145 X |
| 3,861,830 | 1/1975 | Johnson . | |
| 4,243,067 | 1/1981 | Rubey | 251/368 X |
| 4,408,960 | 10/1983 | Allen | 417/149 X |
| 4,640,322 | 2/1987 | Ballester . | |

FOREIGN PATENT DOCUMENTS

| | | | |
|---|---|---|---|
| 187541 | 10/1922 | United Kingdom | 417/145 |

OTHER PUBLICATIONS

Lionel S. Marks, *Standard Handbook for Mechanical Engineers*, 7th ed. McGraw-Hill Book Company, New York, Section 14, pp. 19-20 (1967).

*Primary Examiner*—John C. Fox

*Attorney, Agent, or Firm*—Donald S. Dowden

[57] ABSTRACT

A tubular pump comprises a "tube-within-a-tube" having a lower end adapted to be submerged in a liquid that is under a pressure $p_1$, for example a pressure of one atmosphere. The inner and outer tubes are in communication with each other adjacent to the submerged lower end. A pneumatic system alternately applies a pressure $p_2$ lower than the pressure $p_1$ to both the inner and outer tubes and a pressure $p_3$ higher than the pressure $p_1$ to the inner tube. A check valve mounted in the lower end of the outer tube is open when exposed to the pressure $p_2$ to enable the liquid to flow upward into both tubes to a height $h_1$ supported by the pressure $p_1$ and is closed when exposed to the pressure $p_3$ to prevent the liquid from flowing backward through the check valve. The liquid therefore flows from the inner tube upward through the outer tube in response to the pressure $p_3$. A sump line is connected to the outer tube at a height $h_2$ greater than the height $h_1$. The space between the inner and outer tubes is configured so that the liquid flows upward through the space in response to the pressure $p_3$ as an intact mass. The pump is ideally adapted, for example, to pumping out primary-side water from the lower head connected to the lower ends of steam generator tubes of a single-pass steam generator of a large power station.

18 Claims, 3 Drawing Sheets

HIGH-LIFT TUBULAR PUMP

This is a continuation of application Ser. No. 07/488,888 field Mar. 6, 1990 now abandoned.

BACKGROUND OF THE INVENTION

1. Field of the Invention

This invention relates to pumps and, more particularly, to a novel and highly-effective high-lift pump adapted to pump liquids from locations that are deeply recessed and accessible only via narrow openings—for example, openings having a width of less than an inch.

2. Description of the Prior Art

The gravitational field of the earth interacts with the earth's atmosphere to produce an atmospheric pressure of about 14.7 pounds per square inch at sea level. In other words, a column of air having a cross section of one square inch and extending from sea level to the outer limit of the atmosphere weighs about 14.7 pounds. The pressure of one atmosphere will support a column of liquid to a height such that the pressure at the bottom of the column of liquid is equal to one atmosphere. If a nearly perfect vacuum is maintained above the column of liquid, the columnar height is about 32 feet in the case of water, which has a specific gravity of 1.0. Even at sea level, it is therefore not possible, using only a vacuum, to pump water to a height greater than about 32 feet. Moreover, if a sump line is connected at a height of, say, 30 feet in a system using only a vacuum, the rate of discharge into the sump line will be very low under the best circumstances.

Of course, it is possible by means of positive pressure to pump water to any height. However, positive-pressure pumps of high capacity are conventionally large, often a foot or more in diameter. This precludes their use to pump water from locations that are deeply recessed and accessible only via openings too narrow to admit such pumps. For example, conventional positive-pressure pumps are not satisfactory for use in pumping out primary-side water from the lower head connected to the lower ends of steam generator tubes of a single-pass team generator of a large power station.

Air-lift pumps are also known and are disclosed in Lionel S. Marks, *Standard Handbook for Mechanical Engineers*, 7th ed. (New York: McGraw-Hill Book Company, 1967), section 14, pp. 19–20. In an air-lift pump, an air pipe delivers air to the bottom of a drop pipe inserted for example into a water well and forms a mixture of water and air in the drop pipe that is less dense than the unaerated water in the well. Consequently, the mixture rises in the drop pipe to a level higher than the level of the surrounding water. This process requires a high throughput of air and is relatively inefficient. Moreover, the pumping height that can be achieved is limited by the "submergence" of the pump, which is defined as the difference between the level of the water in the well and the level at which the air enters the drop pipe. For example, for a lift of 25 feet, a submergence of 100 feet is required, and for a lift of 100 feet, a submergence of 200 feet is required. In many environments (e.g., in the lower head connected to steam generator tubes of a single-pass steam generator of certain large power stations), such a large submergence is impossible to achieve.

The broad concept of employing a vacuum to raise a column of water to height supportable by one atmosphere and then applying pressure to the column of water to pump it to a greater height has been known at least since 1847, as evidenced by a U.S. Pat. No. 5,179 to Winder. The Winder patent discloses the use of a pair of bulky airtight cylinders. One of these cylinders is lowered into a well as illustrated in the patent but would be quite impractical for use in pumping out primary-side water from the lower head connected to single-pass steam generator tubes of a large power station.

The same general principle has been applied over the years in various apparatus. U.S. Pats. Nos. 47,034 to Pease, 1,060,826 to De Hymel, 1,778,723 to Oeder, 2,777,399 to Clark, and 2,976,814 to Ver Planck et al. all disclose apparatus for pumping water or oil from a well using alternating vacuum and pressure. A U.S. Pat. No. 3,310,002 to Wilburn discloses the use of a similar principle in laboratory apparatus, and a U.S. Pat. No. 3,861,830 to Johnson and a U.S. Pat. No. 4,640,322 to Ballester disclose apparatus using a similar principle and specially designed to pump dry bulk products (Johnson) or a pulverulent material that behaves as a fluid en masse (Ballester).

The devices disclosed in the prior art are relatively complicated. The above-mentioned patent to Oeder, for example, discloses apparatus that depends on two check valves. A first valve is open and a second valve closed during the suction stroke, and the first valve is closed and the second valve open during the pressure or ejection stroke.

OBJECTS AND SUMMARY OF THE INVENTION

An Object of the invention is to remedy the problems of the prior art noted above and in particular to provide a pump that can pump water to a great height from locations that are deeply recessed and accessible only via narrow spaces—for example, spaces having a width of less than an inch.

Another object of the invention is to provide such a pump that can operate with minimal submergence, that has a high flow rate, and that is of simple construction.

In particular, an object of the invention is to provide a pump that is ideal for use in pumping out primary-side water from the lower head connected to the lower ends of steam generator tubes of a single-pass steam generator of a large power station.

The foregoing and other objects of the invention are attained by the provision of a tubular pump of small diameter that is capable of high lift and high capacity and comprises: tube means having a lower end adapted to be submerged in a liquid to be pumped, the liquid being under a pressure $p_1$ and the tube means being formed with first and second fluid-conducting portions in communication with each other adjacent to the lower end; check valve means mounted adjacent to the lower end; means for alternately applying a pressure $p_2$ lower than the pressure $p_1$ to at least the first fluid-conducting portion and a pressure $p_3$ higher than the pressure $p_1$ to the first fluid-conducting portion, the check valve means being open when exposed to the pressure $p_2$ to enable the liquid to flow upward into at least the first fluid-conducting portion to a height $h_1$ supported by the pressure $p_1$ and being closed when exposed to the pressure $p_3$ to prevent the liquid from flowing backward through the check valve means, and the liquid emptying from the first fluid-conducting portion and flowing upward through the second fluid-conducting portion in response to the pressure $p_3$; and discharge means connected to the second fluid-conducting portion at a height $h_2$ greater than $h_1$; Wherein the second fluid-conducting portion has a configuration such that the liquid flowing upward through the second fluid-conducting portion to the discharge means is in the form of a substantially intact mass.

Preferably, in accordance with the invention, there is provided a pump comprising a "tube-within-a-tube." Both the inner tube and the outer tube are thin-walled and of small diameter. The pressure $p_1$ will typically be supplied by the atmosphere, although it may be artificially supplied and have a value other than one atmosphere. A pneumatic system is preferably employed for generating the respective reduced and increased pressures $p_2$ and $p_3$. The check valve comprises a single nylon ball provided in a cage at the lower end of the outer tube. A relative vacuum resulting in the pressure $p_2$ is drawn preferably on both tubes, and the liquid is lifted in both tubes to the maximum elevation $h_1$ allowed by its vapor pressure (for water under a pressure of one atmosphere, about 32 feet at best and more typically about 30 feet, since it is not practical to establish a perfect vacuum above the column of water). The vacuum is then isolated, allowing the nylon ball to seat. The inner tube is then pressurized to the value $p_3$ to force the water down the inner tube and up the annular space between the tubes to a sump line located at a height $h_2$ greater than $h_1$. The cycle is then repeated, and each cycle results in a discharge of water to the sump line.

As explained in detail below, the apparatus of the invention can reliably pump water from a relatively inaccessible location to a great height using only one check valve.

In accordance with the invention, the compressed air not only evacuates the inner tube but also ensures evacuation of the space between the inner tube and the outer tube as far as the sump line. The inner tube and the outer tube are separated by a clearance that is small enough that the interface between the water and the air remains substantially intact; i.e., the air does not bubble up through the water in the annular space to a significant degree, nor does the water fall into the column of air to a significant degree. Instead, the water is driven as a substantially "solid" mass to the sump line. Of course, it is within the scope of the invention for the water-air interface to break apart to some degree so that the air partially mixes with the water just above the interface. This admixture of air is, however, not the motive force for the operation of the pump in accordance with the invention.

From another standpoint, the invention as explained below and defined in the claims involves a method by which a liquid can be pumped out of a space to which there is access only via a restricted passage.

BRIEF DESCRIPTION OF THE DRAWING

A better understanding of the objects, features and advantages of the invention can be gained from a consideration of the following detailed description of the preferred embodiments thereof in conjunction with the appended figures of the drawing, wherein a given reference character always refers to the same element or part and wherein.

DESCRIPTION OF THE PREFERRED EMBODIMENTS

Figure 1:
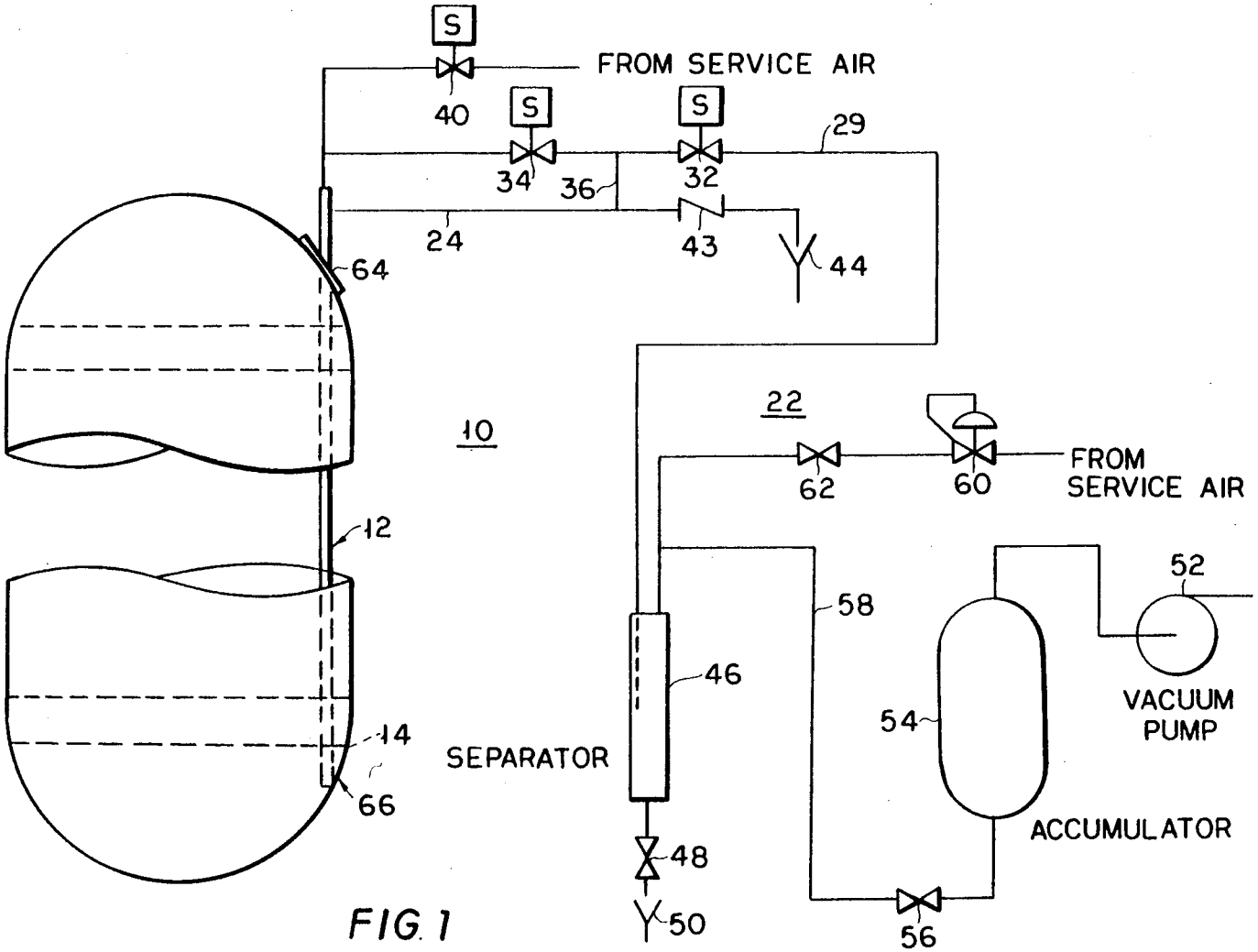
FIG. 1 is a diagrammatic view in elevation of apparatus constructed in accordance with the invention.

FIG. 1 shows pumping apparatus 10 constructed in accordance with the invention. The apparatus 10 is a tubular pump of small diameter that is simple in construction and inexpensive to manufacture yet very reliable and capable of high lift and high capacity even under a condition of minimal submergence. The apparatus 10 comprises tube means such as a composite tube 12 ("tube-within-a-tube") having a lower end 14 adapted to be submerged in a liquid to be pumped. The liquid may for example be primary-side water in the lower head connected to the lower ends of steam generator tubes of a single-pass steam generator of a large power station. The liquid is under a pressure $p_1$, typically one atmosphere, and the composite tube 12 is formed, as FIGS. 2, 3, 4 and 5 show, with first and second fluid-conducting portions such as inner and outer tubes 16 and 18, respectively.

Figures 2, 3:
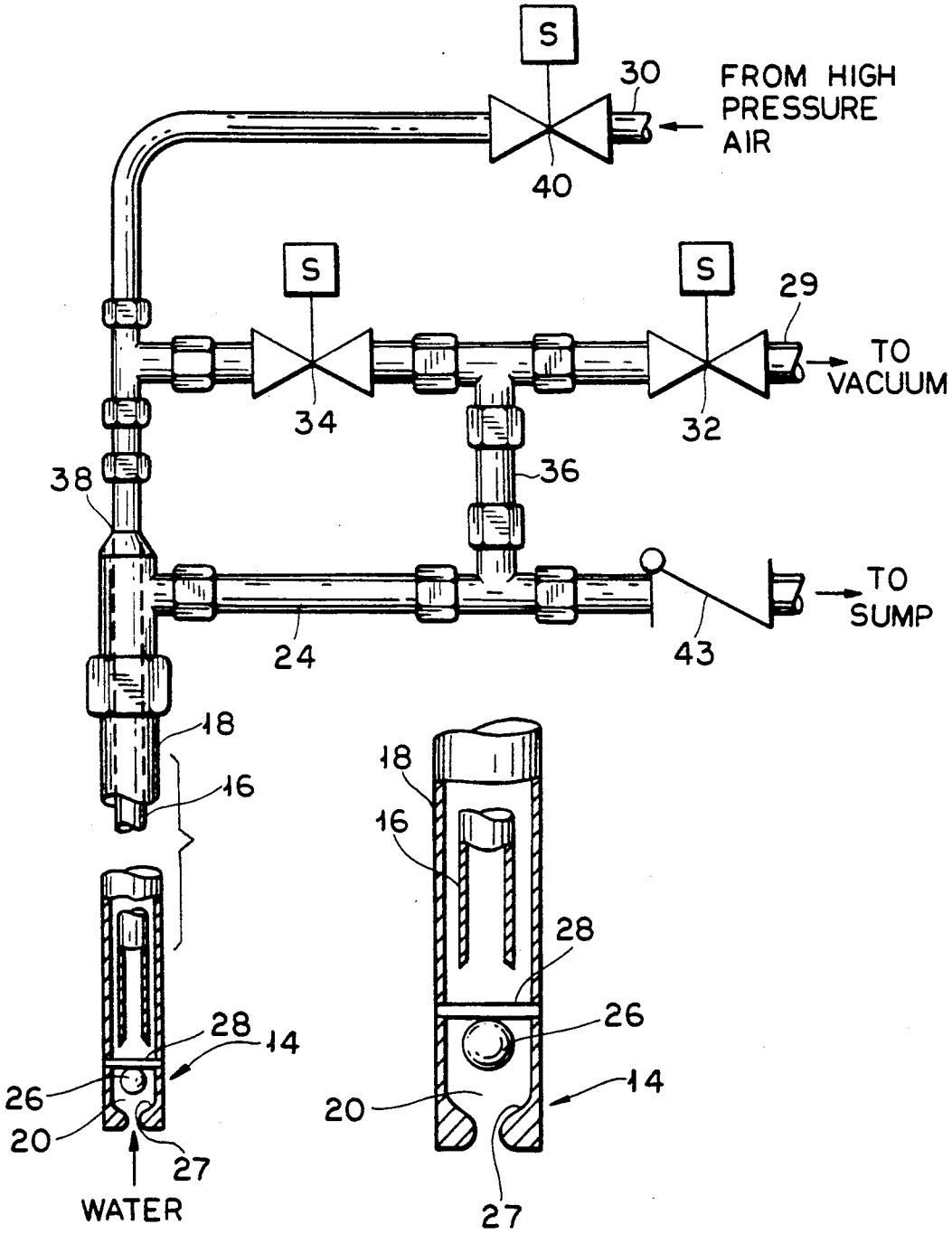
FIG. 2 is a more detailed view in elevation of a portion of the apparatus of FIG. 1.
FIG. 3 is an enlargement of a portion of FIG. 2.
Figure 4:
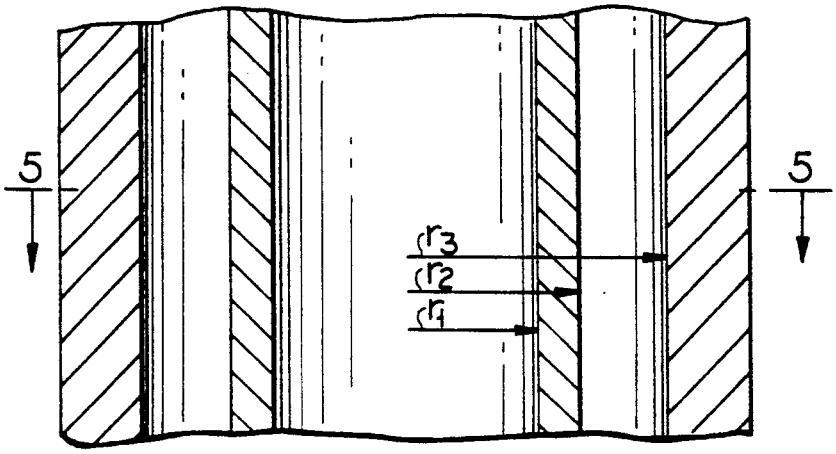
FIG. 4 is a view on a still larger scale in axial section illustrating certain exemplary relative dimensions of a portion of the apparatus of FIGS. 1-3.
Figure 5:
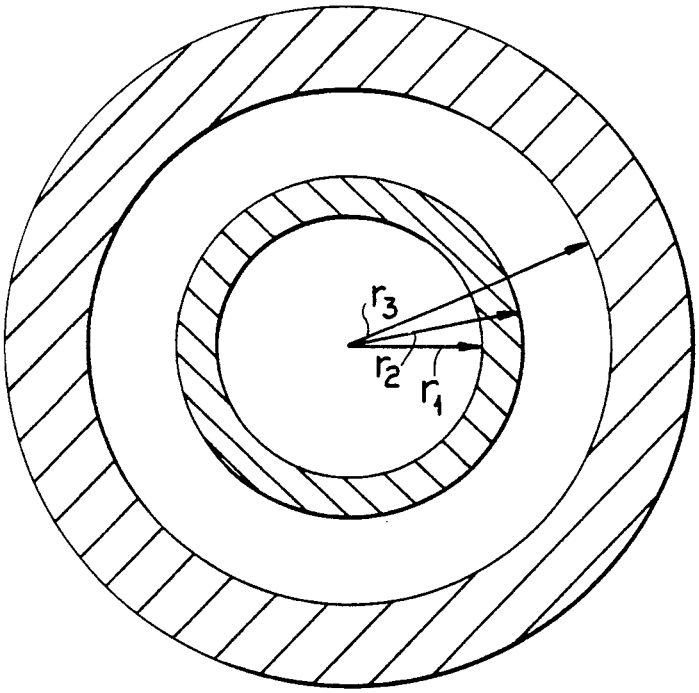
FIG. 5 is a sectional view taken along the line 5—5 of FIG. 4 and looking in the direction of the arrows.

Check valve means such as a check valve 20 (FIGS. 2 and 3) is mounted adjacent to the lower end 14. When the check valve 20 is open, as illustrated in FIGS. 2 and 3, the first and second tubes or fluid-conducting portions 16 and 18 are connected to each other in parallel in the sense that a liquid can flow upward through the check valve 20 and divide so that a portion of the liquid flows into the inner tube 16 and another portion of the liquid flows into the annular space between the inner tube 16 and the outer tube 18. When the check valve 20 is closed, the first and second (inner and outer) tubes 16 and 18 are connected to each other in series in the sense that a liquid can flow serially from the inner tube 16 near the bottom 14 thereof and into the annular space between the inner tube 16 and the outer tube 18.

Means such as a suction-pressure pneumatic system 22 (FIGS. 1 and 2) is provided for alternately applying a pressure $p_2$ lower than the pressure $p_1$ to at least the first fluid-conducting portion 16 (and preferably also to the second fluid-conducting portion 18) and a pressure $p_3$ higher than the pressure $p_1$ to the first fluid-conducting portion 16. That is, the system 22 alternately applies a suction or relative vacuum $p_2$ to the inner tube 16 (and preferably also to the outer tube 18) and a relatively high pressure $p_3$ to the inner tube 16.

The pneumatic system 22 is described in detail below, but its particular design is not critical for purposes of the present invention. Any means for alternately generating the reduced and increased pressures $P_2$ and $P_3$ for the purposes disclosed herein may be substituted for the pneumatic system 22, as those skilled in the art will readily understand.

In accordance with the invention, the check valve 20 is open when exposed to the reduced pressure $p_2$ to enable the water or other liquid to flow upward into at least the first fluid-conducting portion or inner tube 16 to a height $h_1$ (FIG. 6) supported by the pressure $p_1$; on the other hand, the check valve 20 is closed when exposed to the increased pressure $p_3$ to prevent the water from flowing backward through the check valve 20. In response to the increased pressure $p_3$, the water therefore flows out from the bottom of the inner tube 16 and upward through the annular space between the inner tube 16 and the outer tube 18.

Figure 6:
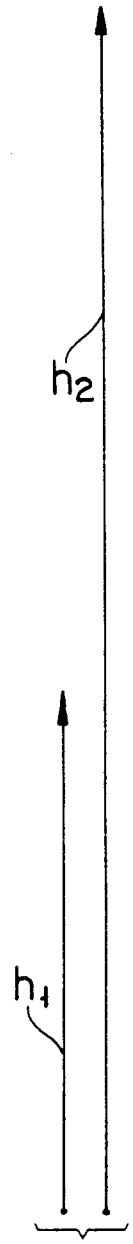
FIG. 6 is a schematic diagram helpful in explaining the operation of apparatus constructed in accordance with the invention.

Discharge means such as a sump line 24 (FIGS. 1 and 2) is mounted in the second fluid-conducting portion or outer tube 18 at a height $h_2$ greater than the height $h_1$, as illustrated diagrammatically in FIG. 6. The second fluid-conducting portion (outer tube) 18 has a liquid-flow cross-sectional area configured so that, during the pressure stroke, the liquid-air interface remains substantially intact as it moves up through the annular space between the tubes 16 and 18, the water being above the interface and the air below it.

The first fluid-conducting portion or inner tube 16 is preferably contained coaxially within the second fluid-conducting portion or outer tube 18, as illustrated in FIGS. 2, 3, 4 and 5. It is not necessary, however, that the two tubes be mounted coaxially; the tube 16 can be mounted eccentrically within the tube 18 and indeed the two tubes can be arranged, for example, side by side, neither being enclosed within the other, so that each is exterior to the other. If each tube is exterior to the other, they are preferably but not necessarily joined along their length.

The composite tube 12 has an exterior diameter that is small and in many environments less than one inch or even substantially a half an inch. Of course, the exact dimensions can be varied in accordance with the width of the narrow space through which the composite tube 12 must be inserted in order to reach the liquid to be pumped, as those skilled in the art will readily understand.

The check valve 20 preferably comprises a ball 26, which is made for example of nylon and has a diameter of ¼" and a density slightly greater than that of the liquid to be pumped and serves as a movable valve member. The check valve further comprises a seat 27 on which the nylon ball presses during the discharge stroke and a pin 28, which is made for example of stainless steel and has a diameter of 1/16" and in cooperation with the inner wall of the outer tube 18 forms a cage limiting the upward movement of the ball 26 during the suction stroke. The open position of the check valve 20 enables flow of the water into at least the inner tube 16 in response to application of the reduced pressure $p_2$. As illustrated in FIGS. 2 and 3, in its open position the valve 20 does not close off the second fluid-conducting portion but enable flow of the water into both the inner tube 16 and the annular space between the inner tube 16 and the outer tube 18 in response to the reduced pressure $p_2$. The relatively high density of the ball 26 enables the check valve 20 to close automatically upon cessation of upward water flow through the valve 20 and even before application of the increased pressure $p_3$.

One cycle of operation consists of the application of the reduced pressure $p_2$, by which a suction or intake stroke is produced, followed by the application of the increased pressure $p_3$, by which a pressure or discharge stroke is produced. On the suction stroke, the water is lifted at least into the inner tube to a height $h_1$ and preferably also into the space between the inner and outer tubes to the same height $h_1$. On the discharge stroke, the water in the inner tube is transferred to the space between the inner and outer tubes.

Where the tubes are cylindrical throughout their extent and mounted coaxially with respect to each other as illustrated in FIGS. 2, 3, 4 and 5, the volume $V_1$ of water drawn into the inner tube during the suction stroke is equal to the area of a circle of radius of $r_1$ (FIGS. 4 and 5), which is the inner radius of the inner tube, multiplied by the height $h_1$ (FIG. 6) to which the water rises on the suction stroke (for practical purposes, this is a maximum height of about 30 feet at sea level). That is, $$V_1 = \pi r_1^2 h_1 \tag{1}$$

The volume $V_2$ of water that will be drawn into the space between the inner and outer tubes during the suction stroke is equal to (a) the area of a circle of radius $r_3$, which is the inner radius of the outer tube, multiplied by the height $h_1$ less (b) the area of a circle of radius $r_2$, which is the outer radius of the inner tube, multiplied by $h_1$. That is, $$V_2 = \pi r_3^2 h_1 - \pi r_2^2 h_1 \tag{2}$$

Therefore, the total amount of water $V_T$, ejected with each complete cycle is $$\begin{aligned} V_T &= V_1 + V_2 \\ &= \pi r_1^2 h_1 + \pi r_3^2 h_1 - \pi r_2^2 h_1 \\ &= \pi h_1 (r_1^2 - r_3^2 - r_2^2) \end{aligned} \tag{3}$$

In principle, this amount of water can be discharged at any height $h_2$, since the space between the inner and outer tubes is configured so that there is so little clearance between the tubes that the water-air interface does not break up to a significant degree and the "solid" column of water above the compressed air can be moved upward through the annular space all the way to the discharge line without breaking apart. Using a composite tube having an outer tube with an outer diameter of ½", an inner tube with an outer diameter of ¼", a clearance between the tubes of 0.093", a laboratory vacuum pump, and a pressure $p_3$ of substantially 50 psi, a test device has pumped water to a height of 70 feet at a flow rate of 0.4 gpm.

The minimum clearance between the tubes will be limited by surface tension, the viscosity of the water, friction with the walls of the tube, manufacturing tolerances as $r_2$ approaches $r_3$, etc. A maximum clearance between the tubes will be limited by the point at which the water-air interface in the annular space between the tubes breaks apart excessively so that the water cannot be discharged to the sump line as a substantially "solid" or intact mass.

As indicated above, the particular means employed for generating the pressures $p_2$ and $p_3$ is not critical. In the preferred embodiment of the invention, a pneumatic system is employed. The pneumatic system 22 (FIGS. 1 and 2) comprises a vacuum line 29 having a diameter of ⅜" and a high-pressure line 30 having a diameter of ¼" (these dimensions are of course merely exemplary and can easily be varied). The vacuum line 29 is connected through valves 32 and 34 to the inner tube 16 and through the valve 32 and a connector 36 to the sump line 24 and the outer tube 18. The inner tube 16 is inserted through an airtight and watertight connector 38 (FIG. 2) into the outer tube 18. Thus when the valves 32 and 34 are both opened (for example by the operation of solenoids S), a reduced pressure or suction $p_2$ is applied both to the inner tube 16 and to the space between the inner tube 16 and outer tube 18.

During the suction or low-pressure stroke, a valve 40 in the high-pressure line 30 is kept closed At the end of the suction stroke, the valves 32 and 34 are both closed, and the nylon ball valve member 26, by virtue of its relatively high specific gravity (greater than 1.0), seats on its valve seat 27.

During the suction stroke, the cage formed with the aid of the pin 28 enables the nylon ball 26 to rise from its valve seat 27 but prevents it from straying far. In particular, it prevents the ball 26 from blocking the entry to the inner tube 16 or, in some possible configurations of the tubes 16 and 18, from blocking the entry to the space between the tubes. The water therefore flows both into the inner tube 16 and into the annular space between the tube 16 and the tube 18 during the suction stroke.

During the pressure stroke, with valves 32 and 34 closed and the valve 40 open, high-pressure air from the high-pressure line 30 forces the water out of the inner tube 16 so that it rises in the annular space between the tubes 16 and 18.

As FIG. 1 shows, the sump line is connected through a trap 43 to a sump or drain 44 by means of which the water is either collected for use in any manner that may be desired or disposed of.

As FIG. 1 also shows, the vacuum line 29 goes to a separator 46 that enables separation of the air from any water that may be incidentally entrained therein. This water is passed through a valve 48 into a sump or drain 50.

A vacuum pump 52 is driven by a suitable prime mover, for example an electric motor or internal-combustion engine (not illustrated), and establishes a low pressure, essentially equal to $p_2$, within a relatively large accumulator 54. If the accumulator 54 is large enough, it can supply a substantially constant reduced pressure $p_2$ over a number of cycles, thereby making it unnecessary to run the vacuum pump 52 continuously during operation of the pumping apparatus 10. A valve 56 is provided in a line 58 between the accumulator 54 and the separator 46. Service air is supplied through a line 30', a pressure-relief valve 60, and a valve 62 for flushing air under high pressure through various parts of the system for purposes of cleaning and servicing. Either the same pump 52 or a different pump (not illustrated) can be employed to generate the service air. An accumulator similar to the accumulator 54 can be employed to store air under pressure so that the pump supplying the service air does not need to run continuously during the operation of the pumping apparatus 10 constructed in accordance with the invention. The same prime mover that runs the pump 52 can run the pump that generates the service air, or a different prime mover can be employed. Also, in some designs, the same pump can be employed to generate both the pressure $p_2$ (at the pump intake) and the pressure $p_3$ (at the pump discharge).

The valves described above can of course be operated manually, especially the ones excluding those identified as 32, 34 and 40. The settings of the former do not need to be changed often, but the settings of the valves 32, 34 and 40 are changed twice during each complete suction-pressure cycle. It is therefore preferable that the valves 32, 34 and 40 be solenoid-operated and that the solenoids be controlled automatically. The provision of such automatic control is well within the competence of those skilled in the art and can be effected very simply with the aid of a mechanism for timing the suction stroke and discharge stroke. A more elaborate control system may employ sensors for reversing the valves in accordance with the detected height of the column of water in the inner tube 16, so that the pressure stroke begins immediately when the height $h_1$ has been attained, and the suction stroke begins immediately when substantially all of the water has been ejected from the outer tube 18.

The composite tube 12 can be passed through an opening 64 that has a width of less than an inch. The outer tube 18 can have an outside diameter of, for example, ½", and the inner tube 16 can have an outside diameter of, for example, ¼". The lower end 14 of the composite tube 12 can be inserted into the upper end of steam generator tubes of a once-through steam generator of a large power station and lowered into the lower head connected to the lower ends of the tubes, as indicated at 66 (FIG. 1).

Thus there is provided in accordance with the invention a novel and highly-effective pump adapted to pump liquids from locations that are deeply recessed and accessible only via narrow openings—for example, openings having a width of less than an inch. The supporting equipment (e.g., vacuum pump, accumulator, solenoid valves) can be placed in accessible areas for ease of assembly, operation and maintenance. The invention remedies the problems of the prior art noted above and in particular provides a pump of small diameter that can operate with minimal submergence and is simple in construction and inexpensive to manufacture yet very reliable and capable of high lift and high capacity.

While the best mode known to the inventor of practicing the invention is disclosed above and illustrated in the drawing, many modifications of it and the other preferred embodiments of the invention will readily occur to those skilled in the art. For example, the design of the check valve 20, the materials of which the composite tube 12 and the check valve 20 are made, the manner of establishing the reduced and increased pressures $p_2$ and $p_3$, the precise values of the reduced and increased pressures $p_2$ and $p_3$, and the environment in which the pumping apparatus is employed may be varied, as those skilled in the art will readily understand. In particular, the manner of establishing the reduced and increased pressures $p_2$ and $p_3$ may include a hydraulic pump: that is, a piston-cylinder assembly may be employed to draw water into the inner tube 16 (and preferably also the outer tube 18) on the suction stroke and eject the water from the inner tube 16 on the pressure stroke. Moreover, a check valve having a hinged valve member instead of a caged ball may be employed. Accordingly, the preferred embodiments of the invention disclosed above are to be understood as merely exemplary, and the invention is not limited except by the appended claims.

I claim:

1. A tubular pump of small diameter that is capable of high left and high capacity and comprises:

tube means having a lower end adapted to be submerged in a liquid to be pumped, the liquid being under a pressure $p_1$ and the tube means being formed with first and second fluid-conducting portions in communication with each other adjacent to the lower end, the first fluid-conducting portion having an outer diameter not exceeding substantially ¼" and the second fluid-conducting portion having an outer diameter not exceeding substantially ½", so that the pump is adapted to be positioned in a location that is deeply recessed and accessible only via a restricted passage;

check valve means mounted adjacent to the lower end;

means for alternately applying a pressure $p_2$ lower than the pressure $p_1$ to at least the first fluid-conducting portion and a pressure $p_3$ higher than the pressure $p_1$ to the first fluid-conducting portion, the check valve means being open when exposed to the pressure $p_2$ to enable the liquid to flow upward into at least the first fluid-conducting portion to a height $h_1$ supported by the pressure $p_1$ and being closed when exposed to the pressure $p_3$ to prevent the liquid from flowing backward through the check valve means, the liquid emptying from the first fluid-conducting portion and flowing upward through the second fluid-conducting portion in response to the pressure $p_3$, at least the pressure $p_3$ being generated by a gas, and the liquid after emptying from the first fluid-conducting portion and while flowing upward through the second fluid-conducting portion in response to the pressure $p_3$ forming an interface with the gas, the liquid being above and the gas below the interface; and discharge means connected to the second fluid-conducting portion at a height $h_2$ greater than the height $h_1$;

wherein the second fluid-conducting portion has a configuration such that the liquid flowing upward through the second fluid-conducting portion to the discharge means is in the form of a substantially intact means, notwithstanding the presence of the gas below the interface.

2. A tubular pump according to claim 1 wherein the first fluid-conducting portion is contained within the second fluid-conducting portion.

3. A tubular pump according to claim 2 wherein the first fluid-conducting portion and the second fluid-conducting portion are coaxial with respect to each other.

4. A tubular pump according to claim 1 wherein the pressure $p_1$ is atmospheric pressure.

5. A tubular pump according to claim 1 wherein the liquid is water. the pressure $p_1$ is atmospheric pressure, and the pressure $p_2$ is such that the pressure $p_1$ will support a column of the water at sea level to a height of substantially 30 feet.

6. A tubular pump according to claim 1 wherein the tube means has an exterior diameter of less than one inch.

7. A tubular pump according to claim 1 wherein the tube means has an exterior diameter of substantially ½ inch.

8. A tubular pump according to claim 1 wherein the check valve means comprises a nylon ball serving as a movable valve member.

9. A tubular pump according to claim 8 wherein the nylon ball has a specific gravity greater than 1.0.

10. A tubular pump according to claim 1 wherein the check valve means has a closed position and an open position, the open position enabling flow of the liquid into the first and second fluid-conducting portions in response to the pressure $p_2$.

11. A tubular pump according to claim 1 wherein the means for applying the pressure $p_2$ comprises a suction line connected to the tube means, suction valve means mounted in the suction line, and means for controliing the suction valve means.

12. A tubular pump according to claim 11 wherein the means for controlling the suction valve means comprises at least one solenoid.

13. A tubular pump according to claim 1 wherein the means for applying the pressure $p_3$ comprises a pressure line connected to the tube means, pressure valve means mounted in the pressure line, and means for controlling the pressure valve means.

14. A tubular pump according to claim 13 wherein the means for controlling the pressure valve means comprises at least one solenoid.

15. A tubular pump according to claim 1 wherein the first and second fluid-conducting portions are both of circular cross section, the first fluid-conducting portion is mounted coaxially within the second fluid-conducting portion, and the exterior radius of the first fluid-conducting portion and interior radius of the second fluid-conducting portion differ from each other by less than one inch.

16. A tubular pump according to claim 15 wherein the difference is less than ½ inch.

17. A tubular pump according to claim 15 wherein the difference is less than ⅛ an inch.

18. A method of pumping a liquid out of a space to which access can be gained only via a restricted passage comprising the steps of:

lowering through the restricted passage and into the space to be pumped one end of composite tube means having a first hollow part and a second hollow part connected to the first part hollow near said one end, the first hollow part having an outer diameter not exceeding substantially ¼" and the second hollow part having an outer diameter not exceeding substantially ½";

submerging said one end in the liquid;

forming an opening into the tube means and applying suction to draw a quantity of the liquid into at least the first hollow part to a height $h_1$;

closing off the opening and applying a gas under pressure to the first hollow part to force the liquid from the first hollow part and up the second hollow part to a height $h_2$ greater than the height $h_1$, the gas following the liquid up the second hollow part and forming an interface with the liquid, the liquid being above and the gas below the interface; and connecting a discharge line to the second hollow part at the height $h_2$ for discharge of the liquid;

wherein the second hollow part is configured so that the liquid flows upwardly therethrough substantially as an intact mass, notwithstanding the presence of the gas below the interface.

* * * * *